US005680712A

United States Patent [19]

Kiyokawa et al.

[11] Patent Number: 5,680,712

[45] Date of Patent: Oct. 28, 1997

[54] SYSTEM FOR DRYING OBJECTS TO BE DRIED

[75] Inventors: Shin Kiyokawa, 402, Benten-cho, Soka-shi, Saitama 340; Masaru Yanagisawa, 40-6, Hon-cho 4-chome, Nakano-ku, Tokyo 164; Hideo Namiki, Tokyo, all of Japan

[73] Assignees: Shin Kiyokawa; Masaru Yanagisawa, both of Tokyo, Japan

[21] Appl. No.: 548,231

[22] Filed: Oct. 25, 1995

[30] Foreign Application Priority Data

Oct. 26, 1994 [JP] Japan ..... 6-262983
Dec. 5, 1994 [JP] Japan ..... 6-301052

[51] Int. Cl.[6] ..... F26B 3/34

[52] U.S. Cl. ..... 34/267; 34/68; 34/196; 34/225

[58] Field of Search ..... 34/267, 535, 538–546, 34/559–569, 61, 68, 192, 196, 214, 225

[56] References Cited

U.S. PATENT DOCUMENTS

| | | | |
|---|---|---|---|
| Re. 28,226 | 11/1974 | Cook . | |
| 92,113 | 6/1869 | Smith | 34/192 |
| 1,353,591 | 9/1920 | Hope et al. | 34/538 |
| 1,536,406 | 5/1925 | Ogden . | |
| 1,547,891 | 7/1925 | Ayres . | |
| 1,950,006 | 3/1934 | Lydon . | |
| 2,370,422 | 2/1945 | Reed . | |
| 2,921,382 | 1/1960 | Blum . | |
| 3,135,589 | 6/1964 | Stokes | 34/267 X |
| 4,501,072 | 2/1985 | Jacobi, Jr. et al. | 34/267 |
| 4,619,054 | 10/1986 | Sata . | |
| 4,665,626 | 5/1987 | Berkmann et al. | 34/267 |
| 4,951,648 | 8/1990 | Shukla et al. | 34/225 X |
| 5,079,855 | 1/1992 | Carrier | 34/225 |

FOREIGN PATENT DOCUMENTS

| | | |
|---|---|---|
| 0154265 | 9/1985 | European Pat. Off. . |
| 0486035 | 5/1992 | European Pat. Off. . |
| 0486036 | 5/1992 | European Pat. Off. . |
| 1096717 | 6/1955 | France . |
| 56-124337 | 9/1981 | Japan . |
| 60-120973 | 6/1985 | Japan . |
| 61-128085 | 6/1986 | Japan . |
| 63-201493 | 12/1988 | Japan . |
| 02029590 | 1/1990 | Japan . |
| 123984 | 1/1920 | United Kingdom . |

OTHER PUBLICATIONS

Junsaku Nonaka, editor. "Marine Useful Materials", New Complete Edition of Science of Fisheries No. 23, Koseisha Koseikaku Co., Ltd., 4 pages (partial English translation, 6 pp.).

Paten Abstracts of Japan, Publication No. 60120973 A, 1985, 1 page.

Patent Abstracts of Japan, Publication No. 02029590 A, 1990, 1 page.

*Primary Examiner*—John M. Sollecito
*Assistant Examiner*—Steve Gravini
*Attorney, Agent, or Firm*—Webb Ziesenheim Bruening Logsdon Orkin & Hanson, P.C.

[57] ABSTRACT

A far infrared radiation heater 33 is disposed on the back of a ceiling of a drying chamber 11. The inside of the drying chamber 11 is evenly heated by the heat emitted from the far infrared radiation heater 33. The drying chamber 11 is provided with air charge means 16 and air exhaust means 17 each communicating with the inside thereof. Outside air is introduced into the drying chamber 11 by means of the air charge means 16. On the other hand, the air exhaust means 17 continuously maintains the inside of the drying chamber 11 in a state of reduced pressure. Thus, objects to be dried which are placed in the drying chamber are dried by heating under reduced pressure while continuously introducing fresh air. Therefore, the present invention provides a system for drying objects to be dried whereby not only can dried products be produced within a short period of time but also the flavor is satisfactorily retained in the dried products.

5 Claims, 12 Drawing Sheets

SYSTEM FOR DRYING OBJECTS TO BE DRIED

BACKGROUND OF THE INVENTION

1. Field of the Invention

The present invention relates to a system for drying objects to be dried. More particularly, the present invention is concerned with a system for drying objects to be dried by which, for example, the objects such as marine and agricultural products, flowers, woods and lumbers can be efficiently dried.

2. Description of the Prior Art

Dried fishes or stockfishes which not only can be stored for a prolonged period of time but also possess peculiar flavors are produced from fish of family Scombroidea and Carangidae and other various marine products and are supplied to the market.

In the conventional drying system for obtaining such dried products, as shown in FIG. 12, heating means 3 such as a boiler is disposed beside a drying chamber 2 in which objects to be dried 1 are housed. While hot air or blast generated from the heating means 3 is fed into the drying chamber 2, the air inside the drying chamber 2 is transferred into a cooling chamber 4. In this cooling chamber 4, the air led from the drying chamber 2 is cooled and dehumidified. The dehumidified air is recycled via the heating means 3 into the drying chamber 2, while part of the air dehumidified in the cooling chamber 4 is directly fed into the drying chamber 2. That is, in the conventional system, dried goods are produced by circulating air.

However, in the above conventional system for drying objects to be dried, the temperature of the inner part of the drying chamber 2 is raised by hot air or blast fed from the heating means 3 and water evaporation from the surface of each of the objects to be dried 1 is conducted by the heat given by the hot air or blast, so that a great many days have been taken during the period from the start of the drying to the output of the dried products. This has brought about a problem that, even if dried products are produced from fresh marine products, the objects to be dried are oxidized during the production of dried fishes or stockfishes, thereby losing their freshness. Further, a large quantity of energy is required for the heating, thereby causing the cost of the dried products to be unfavorably high. Still further, in the conventional drying system, not only is the regulation of the moisture content of the dried products difficult but also the moisture of the inner part of the objects to be dried cannot be evaporated to a desired degree, so that there has been a limit in the deliciousness in the eating of the dried products. Still further, the conventionally produced dried products contain some ordinary levels of various common bacteria or germs, so that the duration in which the relish of, for example, dried salmons is ensured is as short as about one month thereby necessitate a quick delivery from the distributive machinery to the table.

This invention has been made to overcome the above problems of the prior art. Therefore, the objective of the present invention is to provide a system for drying objects to be dried by which dried products can be produced within a short period of time, the drying cost is low, the production of the dried products can be accomplished without detriment to fresh flavor and the amount of various common bacteria or germs contained in the dried products can be reduced to thereby extend the duration in which the relish of the dried products is ensured.

SUMMARY OF THE INVENTION

The system for drying objects to be dried according to the present invention comprises a drying chamber having walls including side walls and a ceiling in which objects to be dried are housed, a far infrared radiation heater disposed on at least a part of the walls to evenly heat the inside of the drying chamber with heat emitted from the far infrared radiation heater and air charge and air exhaust means both communicating with the inside of the drying chamber, the former introducing outside air into the drying chamber while the latter exhausting the air from the drying chamber to thereby continuously maintain the inside of the drying chamber in a state of reduced pressure, wherein the temperature of the inside of the drying chamber is detected with the use of a temperature sensor and output of the far infrared radiation heater regulated on the basis of the temperature detected by the temperature sensor and wherein the air charge and air exhaust means being separately controlled.

In the system for drying objects to be dried according to the present invention, which has the construction as described above, circulatory blowing means may be provided at one of a pair of mutually opposite side wall surfaces inside the drying chamber, the circulatory blowing means being capable of generating a substantially horizontal air stream flowing to the opposite side wall surface, to thereby cause the circulatory blowing means to feed air so as to form a horizontal air stream flowing toward the object to be dried.

In the system for drying objects to be dried according to the present invention, the inside of the drying chamber is uniformly heated by means of the far infrared radiation heater, the air stream inside the drying chamber is circulated to thereby promote the drying and further the inside of the drying chamber is maintained in a state of reduced pressure, so that moisture can be evaporated not only from the surface of each of the objects to be dried but also from the inner part thereof with the input of less energy within a short period of time.

Further, the system for drying objects to be dried according to the present invention comprises a drying chamber in which a plurality of trucks each having a vast plurality of objects to be dried shelfwise housed therein can be linearly accommodated, a plurality of far infrared radiation heaters disposed at predetermined intervals at upper parts of the drying chamber to evenly heat the inside of the drying chamber with the heat emitted from the far infrared radiation heaters and air charge and air exhaust means both communicating with the inside of the drying chamber, the former introducing outside air into the drying chamber while the latter exhausting the air from the drying chamber to thereby continuously maintain the inside of the drying chamber in a state of reduced pressure, and wherein circulatory blowing means is provided at one of a pair of mutually opposite side wall surfaces inside the drying chamber, the circulatory blowing means being capable of generating a substantially horizontal air stream flowing the one side wall surface to the opposite side wall surface, to thereby cause the circulatory blowing means to feed air so as to form a horizontal air stream flowing toward the inner part of the trucks.

In the above system for drying objects to be dried, with respect to the plurality of far infrared radiation heaters disposed at predetermined intervals, the air stream generated by the circulatory blowing means can be so set as to flow from the one side wall surface to the opposite side wall surface along the side of a first far infrared radiation heater, to flow from the opposite side wall surface to the one side wall surface along the side of a second far infrared radiation heater, to flow from the one side wall surface to the opposite side wall surface along the side of a third far infrared radiation heater, and thus to alternately flow in the same direction in the entirety of the drying chamber.

Moreover, the air stream generated by the circulatory blowing means can be so set as to flow counter at predetermined time intervals.

The system for drying objects to be dried according to the present invention forms the substantially horizontal flow of an air stream in the drying chamber by means of the circulatory blowing means, so that the surface of each of the objects to be dried housed in the trucks can be positively dried by this flow of the air stream to thereby remove moisture from the surface.

Further, the setting of the air stream generated by the circulatory blowing means so as to flow in alternately opposite directions along the sides of a vast plurality of far infrared radiation heaters enable the air stream to evenly flow through the entirety of the drying chamber, so that a vast plurality of objects to be dried can be dried substantially uniformly.

Still further, the setting of the air stream set to flow in alternately opposite directions so as to flow counter at predetermined time intervals can accomplish drying of a vast plurality of objects to be dried with further improved uniformity.

DETAILED DESCRIPTION OF THE INVENTION

Figure 1:
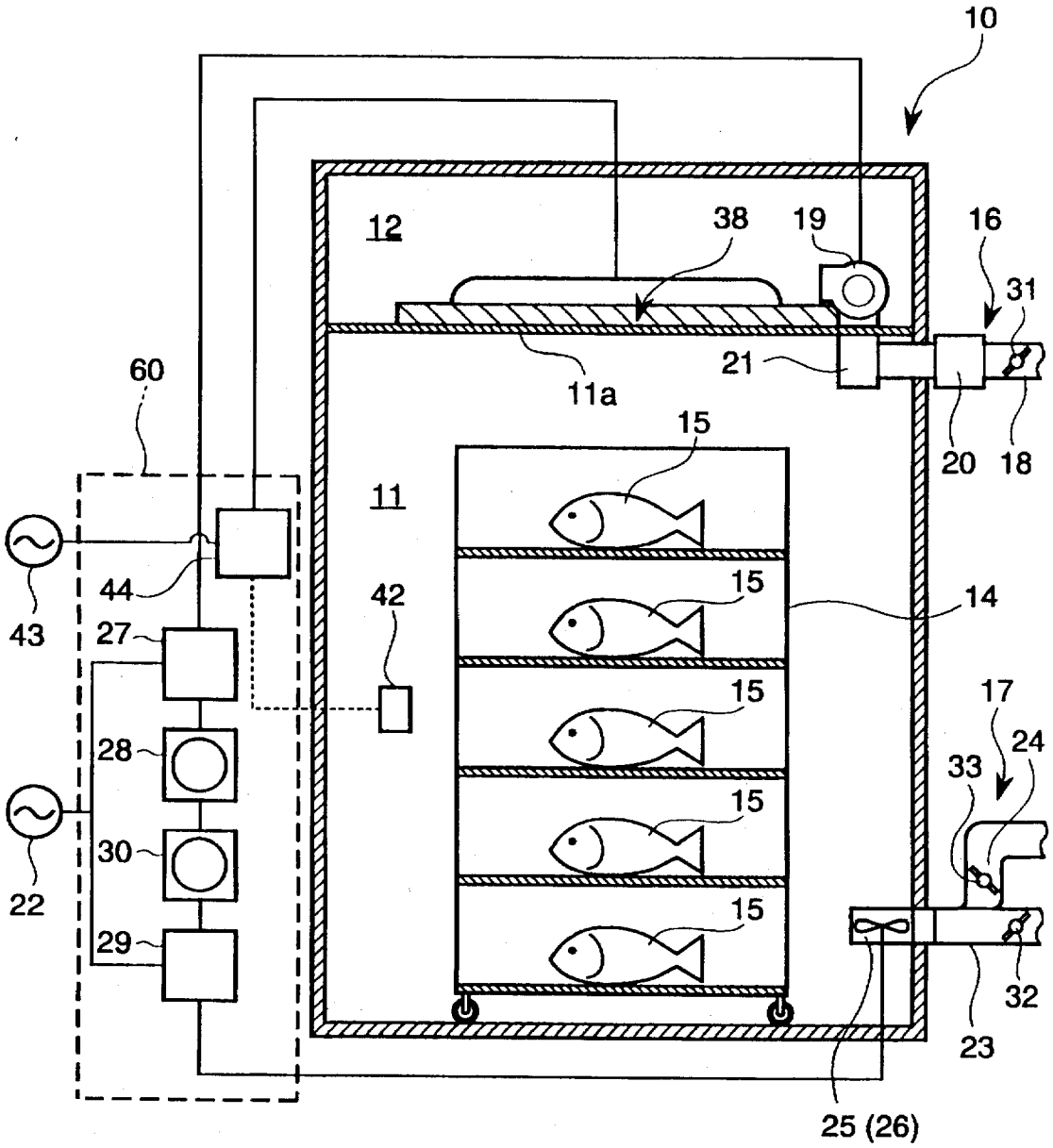
FIG. 1 is a sectional view showing a system for drying objects to be dried according to one embodiment of the present invention.

Referring to the drawings, embodiments of the system for drying objects to be dried according to the present invention will be described below.

Figure 2:
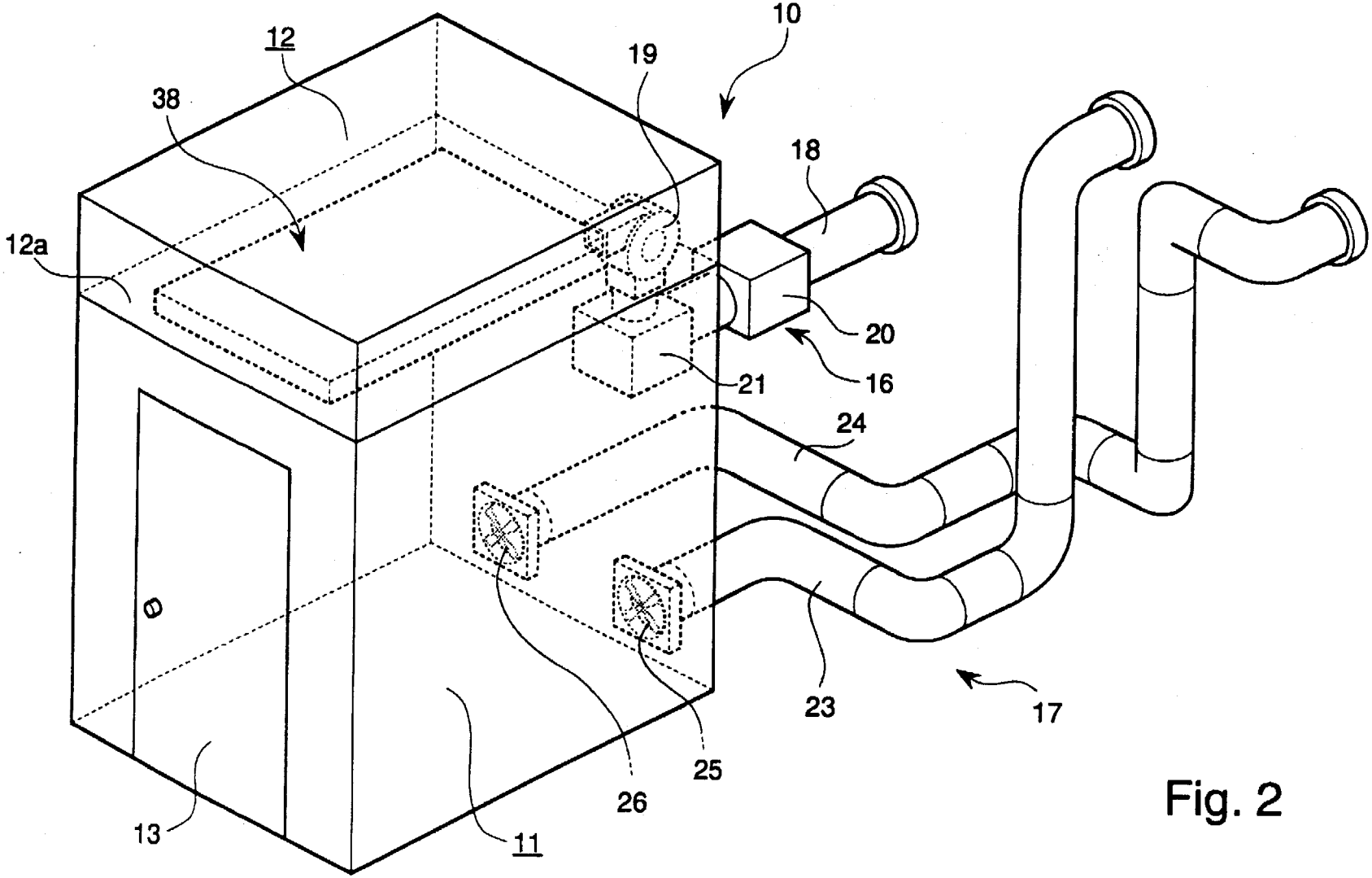
FIG. 2 is a schematic perspective view showing the drying system according to the above embodiment.

FIG. 1 schematically shows a system for drying objects to be dried according to one embodiment of the present invention, and FIG. 2 is a schematic perspective view thereof.

In this drying system 10, a second chamber 12 is constructed above a drying chamber 11 having its periphery surrounded with a thermal insulating material. The drying chamber 11 has a gate 13 through which entrance and exit can be made.

A truck 14 is loaded with a vast plurality of objects to be dried 15 in multilayered form and placed in the drying chamber 11 to thereby have the objects to be dried housed in the drying chamber 11.

The drying chamber 11 is provided with air charge means 16 and air exhaust means 17 which are separately disposed in communicating relationship with the inside of the drying chamber 11 at upper and lower parts of the drying chamber 11, respectively.

The air charge means 16 introduces outdoor fresh air via a pipe 18 into the drying chamber 11 and circulates an air stream in the drying chamber 11. Outdoor air is suctioned by a fan 19 installed in the second chamber 12. The suctioned air is temporarily introduced via air filters 20, 21 into the second chamber 12 and then fed via an opening (not shown) formed through a ceiling 11*a* of the drying chamber 11 into the drying chamber 11.

The air fed into the drying chamber 11 appropriately circulates between the drying chamber 11 and the second chamber 12 by means of the air charge means 16. Accordingly, circulation of an air stream is generated in the drying chamber 11.

The air exhaust means 17 exhausts air humidified in the drying chamber 11 outdoors via two pipes 23, 24 disposed beside the drying chamber 11 and is equipped with blowers 25, 26 driven by a single or separate motors.

The pipe 18 of the air charge means 16 and the pipes 23, 24 of the air exhaust means 17 are respectively provided with valves 31, 32, 33, which are manually or automatically operated to thereby regulate the openness of each of the pipes.

In the air charge means 16, the quantity of suctioned air is regulated by means of a regulator 27 of a control panel 60. The quantity of suctioned air is set by means of an air quantity setting device 28.

On the other hand, in the air exhaust means 17, the quantity of exhausted air is regulated by means of a regulator 29. The quantity of exhausted air is set by means of an air quantity setting device 30. For example, the air exhaust capacity ranges from a maximum of 1500 $m^3/h$ to a minimum of 500 $m^3/h$.

Both of these air charge means 16 and air exhaust means 17 are operated by a 100-V power source 22.

Figure 3:
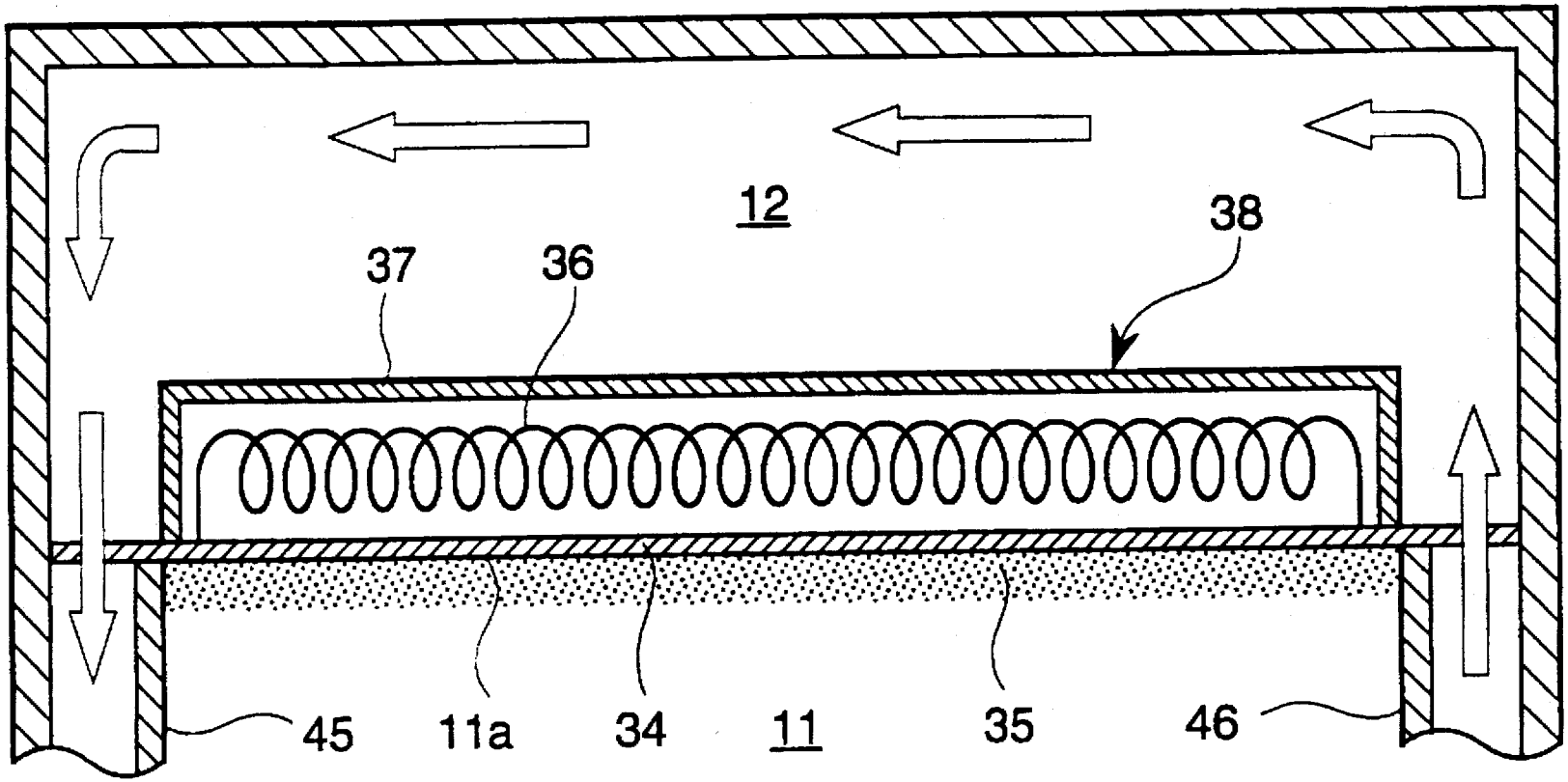
FIG. 3 is a sectional view showing a far infrared radiation heater employed in the above embodiment.

A far infrared radiation heater 38 shown in FIG. 3 is disposed on the ceiling 11*a* of the drying chamber 11.

In this far infrared radiation heater 38, a ceramic spray deposit layer 35 is provided on a base material 34 forming the ceiling 11*a*. Heating means 36 is arranged on the back of the base material 34, and its outside is covered with a casing 37.

The above base material 34 is, for example, an Al plate of 2 mm in thickness, and the thickness of the ceramic spray deposit layer 35 is about 20 μm. The member composing the base material 34 is not particularly limited as long as it is a material suitable for use as a base of thermal ceramic spraying. The base material 34 may be composed of stainless steel or other materials. A porous plate such as a punching plate may also be used, in which the pores may be used as a passage for air.

It is not necessary to compose the above ceramic of a single type of raw material, and a composition of various raw materials mixed together may be used to compose the ceramic. Although the raw material to be employed is not particularly limited, for example, zirconia, magnetite, alumina, zircon, iron, chrome, mangan and other compound oxides may be mentioned as raw materials for composing ceramics capable of emitting far infrared radiation in greater intensities.

The thermal spraying of ceramic is generally conducted with the use of a plasma spraying gun. This plasma spraying gun produces an ultrahigh temperature plasma arc flame of at least ten thousand °C., into which pulverized raw material is fed. The raw material is melted in a high-speed jet of 1–2 in Mach number and caused to strike the surface of the target base material to thereby form a ceramic layer.

The far infrared radiation heater 38 for use in this embodiment is constructed as described above over the substantially entire surface of the ceiling 11*a* of the drying chamber 11 and driven by a 200 V power source 43 as shown in FIG. 1.

The drying chamber 11 has a temperature sensor 42 disposed therein and is provide with an inverter 44 as shown in FIG. 1. The output of the above far infrared radiation heater 38 can be continuously regulated.

Figure 4:
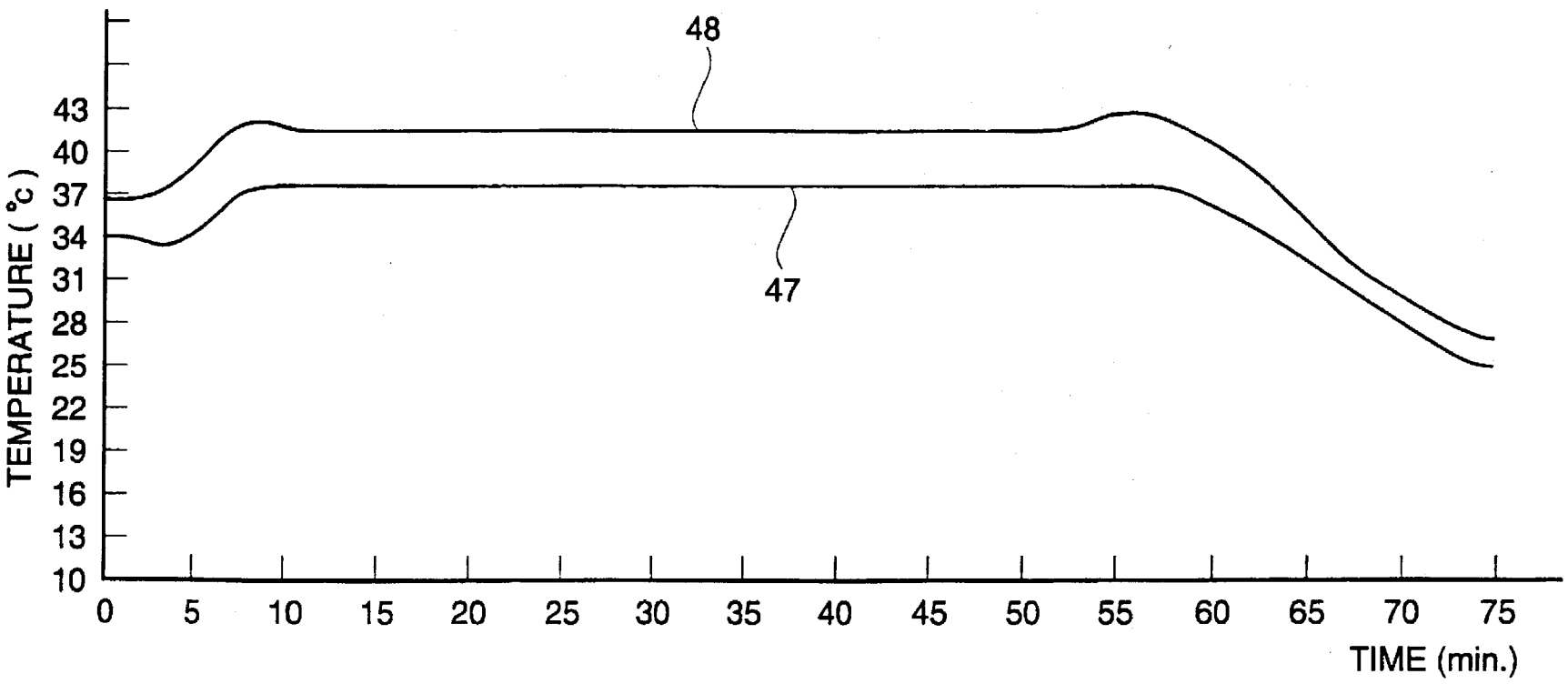
FIG. 4 is a graph showing an example of temperature change inside a drying chamber according to the above embodiment.

When the above far infrared radiation heater 38 is used, the temperature at 2.5 m above the floor surface reaches predetermined 37° C. about 10 min after the start of the driving of the far infrared radiation heater 38 as indicated by full line 47 in FIG. 4. The temperature at the vicinity of the floor is about 41° C., which is higher than the above-mentioned temperature as indicated by full line 48 in FIG. 4. Therefore, the objects to be dried is placed at the vicinity of the floor can also be effectively dried in the drying chamber 11. The use of the above far infrared radiation heater 38 leads to releasing of moisture not only from the surface of each of the objects to be dried but also from the center thereof with less energy input because of high far infrared radiation efficiency. Experimental results demonstrated the release of moisture from the inner part in an amount of twice that attained by the drying performed with the use of the conventional heating means.

The construction of the system 10 for drying objects to be dried according to this embodiment is as described above. The function of the system will now be described below.

At this time, a vast plurality of objects to be dried 15 are housed in layered form in the truck 14 and accommodated in the drying chamber 11. The air charge means 16, air exhaust means 17 and far infrared radiation heater 38 are regulated by the control panel 60 and are individually driven.

Outside fresh air is fed via the second chamber 12 into the drying chamber 11 by the air charge means 16. In the drying chamber 11, convection current occurs and an air stream is circulated. The air is exhausted from the drying chamber 11 to the outside by the air exhaust means 17. In the drying chamber 11, air exhaust is conducted so that the pressure is held at, for example, 3 mb or more, preferably 10 mb or more below atmospheric pressure.

Further, in the drying chamber 11, far infrared radiation which is easily absorbed by the objects to be dried 15 is emitted from the ceiling 11*a* by the drive of the far infrared radiation heater 38.

Therefore, in this drying chamber 11, the inner parts thereof are heated substantially uniformly, the air stream is circulated and the pressure is reduced, so that moisture evaporation is promoted. With respect to the objects to be dried 15 housed in the truck 14, moisture evaporation occurs not only from the surface but also the center thereof. Thus, moisture evaporation can be effected rapidly in this drying chamber 11, so that the drying time can be cut down. Upon completion of the above requisite drying, the drive of the far infrared radiation heater 38 is stopped, preferably followed by putting the dried objects in rest for cure in the drying chamber 11 for a given period of time.

Examples of the objects to be dried in the drying chamber 11 include horse mackerel or saurel, mackerel or scombroid, salmon, anchovy, sardine paper, flatfish or plaice and other fishes and octopus, scallop, amanori or laver, sea tangle, kind of carpenter's tellin, trepang or sea slug and other marine products.

Further, the objects to be dried include woods and agricultural products, for example, cereals such as rice, fruits such as persimmon, and vegetables such as green pepper, carrot, cabbage, tuber (potato) or corm (sweet potato), bamboo shoot and mushroom. Still further, flowers (to give dry flowers) and animal bones can be dried. In particular, the drying of animal bones leads to sterilization of meat pieces and their adherence to the bones, thereby supplying the market with delicious products appreciated as pet foods of fine quality.

Naturally, the system is applicable to drying of the washing and of industrial products after washing, such as IC chips after washing.

In other fields of application, this system can be appreciated when drying fossils containing water in a large quantity. For example, although the drying of sand containing shell fossils has heretofore been effected by heating a large quantity of sand at about 1000° C., the whole sand can be uniformly dried at temperatures as low as about 50° C. with the use of this system. Thus, shell fossils can be recovered from the sand in a state of fine quality and stored.

The drying for producing, for example, sardine paper as a marine product has heretofore been carried out in the sun, so that the production of the dried fish is influenced by the weather. However, the sardine paper can be produced with no care of the weather by the use of the above drying system 10 according to this embodiment of the present invention. Therefore, the production of dried fish or stockfish can be performed in accordance with the plan set. In the production of sardine paper, excessive drying makes sardine constituting the paper separated one by one.

However, the degree of dryness can be appropriately regulated by controlling the temperature of the drying chamber, the drying time and the pressure from the control panel 60 of the above drying system 10. Thus, a desirable sardine paper production can be accomplished.

This embodiment does not cool humidified air but expels it outside, thereby saving the conventionally required energy for cooling. Further, the drying can be achieved within a short period of time by the use of far infrared radiation, so that the production cost can be reduced. The short drying time avoids oxidation of the objects to be dried. Thus, dried goods with high freshness can be produced, which is delicious when eaten.

The conditions for treating objects to be dried such as fishes and shellfishes with the use of the above system to thereby produce dried goods ensuring favorable taste will be described below.

When fishes or shellfishes are brought to death, the meat quality changes with the lapse of time. That is, ATP (adenosine triphosphate) occurring in the muscle decomposes as follows:

ATP→ADP (adenosine diphosphate)→AMP (adenylic acid)→IMP (inosinic acid)→HxR (inosine)→Hx (hypoxanthine).

It has been shown by experiments that the rate of the above decomposition highly depends on the type of fish or shellfish. There is a close relationship between the amount of inosinic acid and the deliciousness, and it is known that, generally, the greater the content of inosinic acid, the better the taste.

Figure 5:
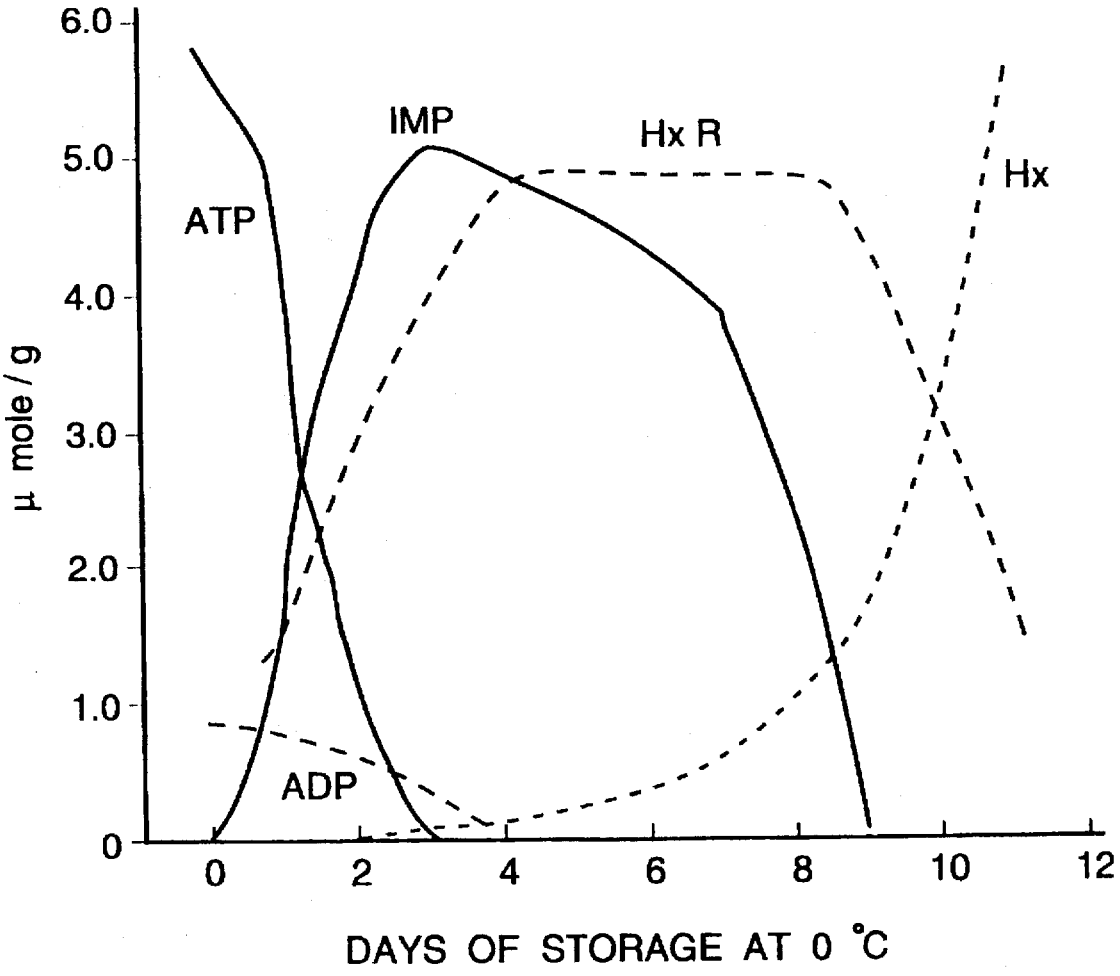
FIG. 5 is a graph showing how ATP-associated compounds contained in a muscle of a cod being an example of objects to be dried changes with the lapse of time.

In the fish meat, the content of ATP (adenosine triphosphate) is rapidly reduced after death, and instead the content of IMP (inosinic acid) is increased. For example, FIG. 5 shows changes in the contents of ATP-associated compounds occurring in the muscle of a cod subjected to euthanasia ("marine useful materials", page 199 of New Complete Edition of Science of Fisheries, edited by Junsaku Nonaka). As apparent from this figure, the content of IMP is increased with the decrease of the content of ATP and reaches the maximum 2 to 3 days after death. When the drying of the object to be dried is terminated at the maximum content of IMP, the dried product is delicious.

In the system of the present invention, not only is the drying time extremely short as compared with that of the conventional means but also the temperature and pressure during the drying can be freely regulated by the use of the far infrared radiation heater, air charge and air exhaust means. Therefore, the system can be regulated so as to terminate the drying when the content of inosinic acid is at the maximum. Consequently, dried products whose inosinic acid content is at the maximum can be obtained without exception no matter what types of objects are to be dried. In the drying of, for example, raw fish with the use of this system, the drying temperature, for example, ranges from 0° to 50° C., preferably from 10° to 40° C., and appropriate temperature regulation comprising, for example, initial drying at 30° C. for 20 hr followed by drying at 10° C. for 30 hr followed by heating at 38° C. can be effected so as to obtain a dried product whose inosinic acid content is at the maximum.

Further, the drying of, for example, raw fish by the conventional drying method denatures the protein because of the heat, thereby deteriorating the flavor of the fish meat protein. In contrast, the present invention achieves uniform heating of the whole at low temperatures, e.g. about 38° C., so that denaturation of the protein can be avoided to thereby produce a dried product which is delicious when eaten.

Still further, when fishes or shellfishes die and the amount of ATP is reduced to a certain level, they generally undergo cadaveric rigidity. When ATP is consumed up, the cadaveric rigidity is completed. When fish before the cadaveric rigidity is frozen, no significant change occurs in the fish during the freezing period but at the thawing it is likely that the fish body undergoes cadaveric rigidity, the meat pieces shrink and simultaneously a large amount of drip flows out. The use of the system of the present invention in drying previously frozen fish or shellfish permits the regulation of the temperature and pressure so that the inosinic acid content of the dried product is maximized as in the drying of fish after the occurrence of cadaveric rigidity subsequent to death.

If the changes such as the vanishment of ATP and the stiffening of the muscle which usually occur gradually after death are advanced within a short period of time, the degree of shrinkage of the muscle is generally high. However, when the drying is conducted with the use of the drying system of the present invention, it has been confirmed that the meat of the fish or shellfish has less propensity for shrinkage or cracking, thereby producing a dried product whose size is close to that before the drying.

In the above embodiment, the far infrared radiation heater is disposed on the ceiling. However, the part where the far infrared radiation heater can be disposed is not limited to the ceiling and includes, for example, right and left walls or four walls. Although the air charge means is disposed at an upper part and the air exhaust means at a lower part in the above embodiment, this may be reversed, that is, the air charge means may be disposed at a lower part and the air exhaust means at an upper part. Further, for example, the number of air intake ports of the air charge means and the number of air exhaust ports of the air exhaust means are by no way limited to those of the above embodiment. This system can be practiced in various different sizes from large to small ones.

A second system for drying objects to be dried according to another embodiment of the present invention will be described below with reference to FIGS. 6 to 8.

Figure 6:
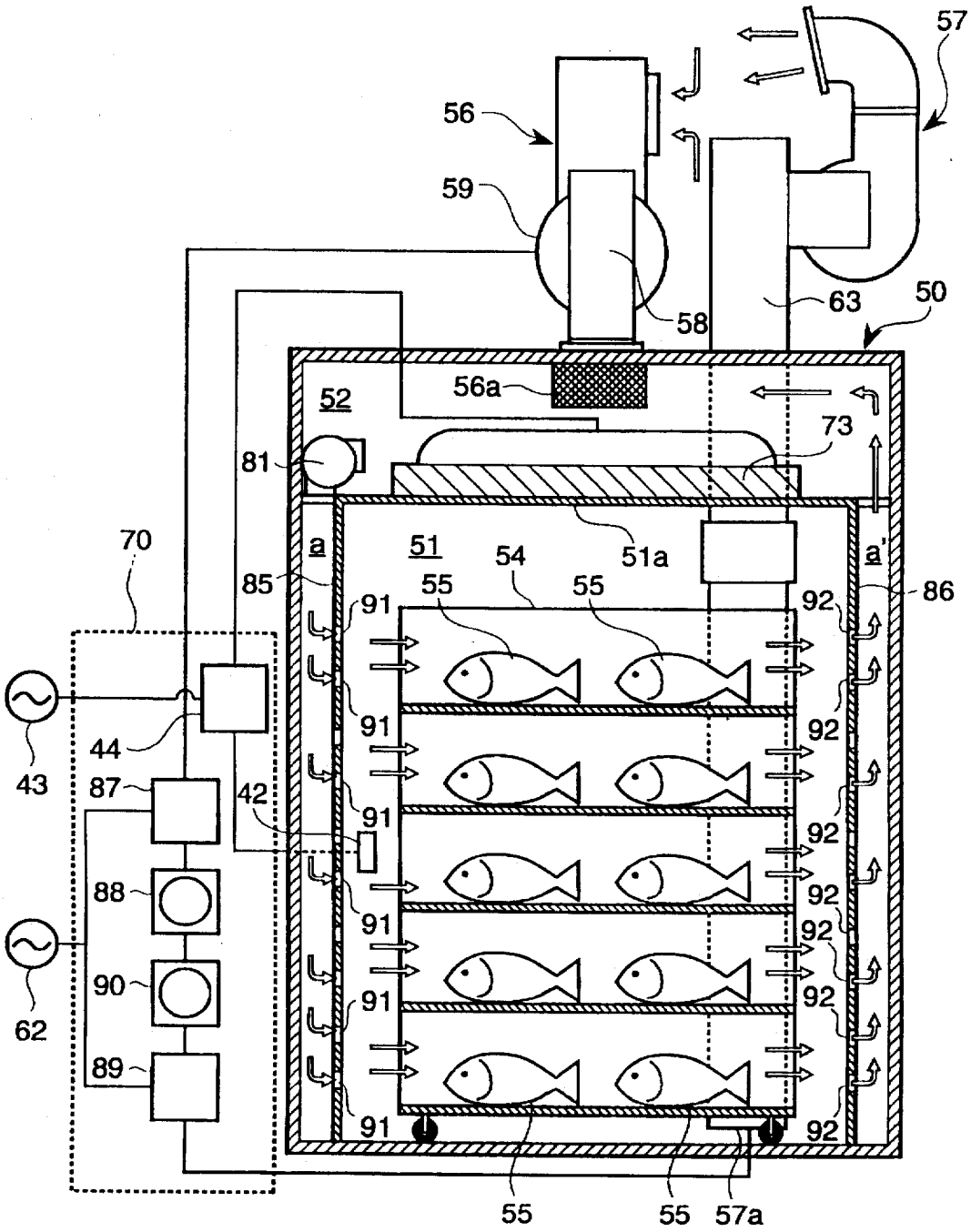
FIG. 6 is a sectional view showing a system for drying objects to be dried according to another embodiment of the present invention.
Figure 7:
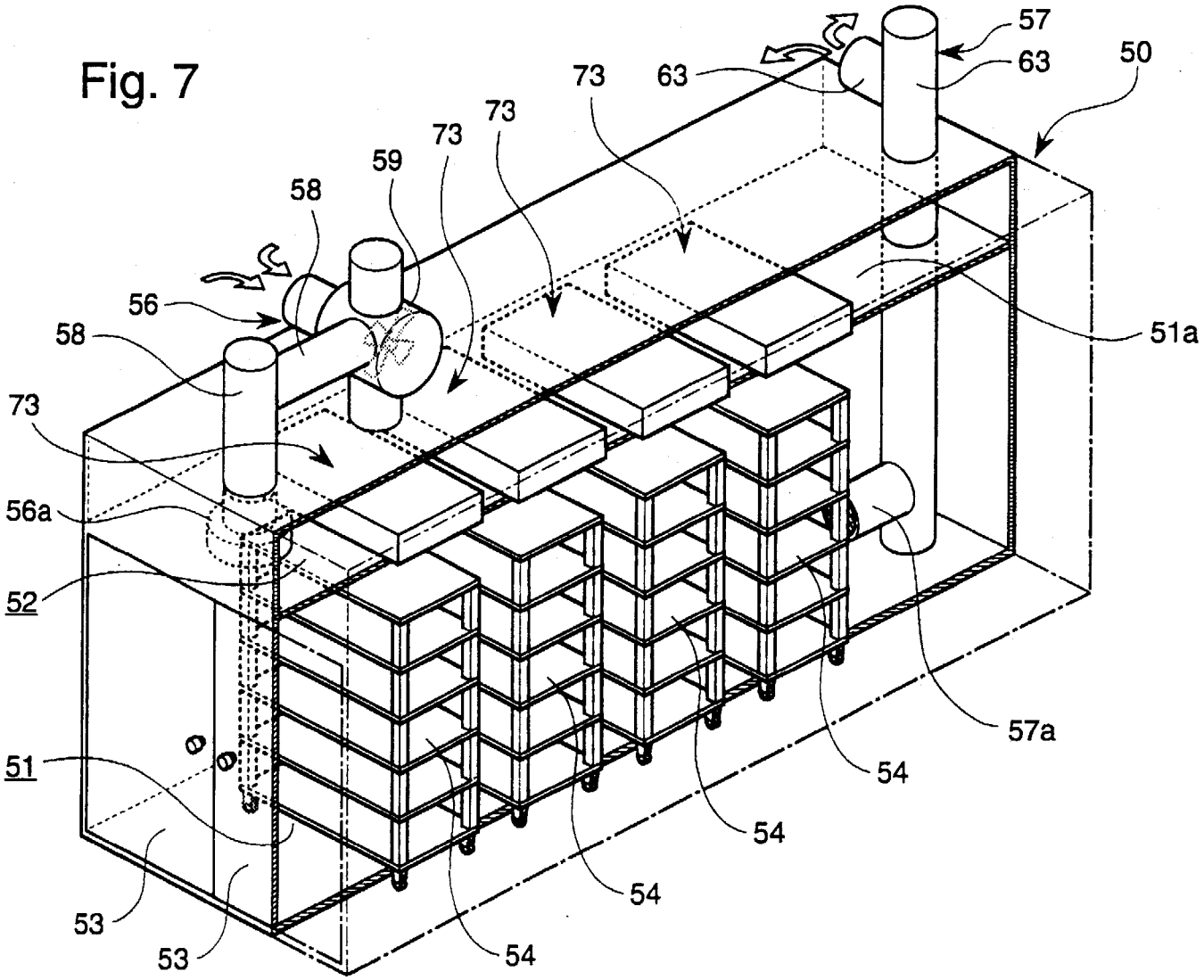
FIG. 7 is a schematic perspective view showing the drying system according to the above embodiment.

FIG. 6 schematically shows a system for drying objects to be dried according to another embodiment of the present invention, and FIG. 7 is a schematic perspective view thereof.

This drying system 50 is constructed in a large box frame with thermal insulating structure whose size is approximately 7 m in length, 2.4 m in width and 2.6 m in height. The box frame can be installed outdoors. In the drying system 50, a second chamber 52 is constructed above a drying chamber 51 having its periphery surrounded with a thermal insulating material. The drying chamber 51 has a gate 53 through which entrance and exit can be made.

Trucks 54 each of which is loaded with a vast plurality of objects to be dried 55 in multilayered form are placed in the drying chamber 51 to thereby have the objects to be dried 55 housed in the drying chamber 51.

The drying chamber 51 is provided with air charge means 56 and air exhaust means 57 which are separately disposed in communicating relationship with the inside of the drying chamber 51. An air charge port 56*a* of the air charge means 56 and an air exhaust port 57*a* of the air exhaust means 57 are disposed at upper and lower parts of the drying chamber 51, respectively.

The air charge means 56 introduces outdoor fresh air via a pipe 58 into the drying chamber 51 and circulates an air stream in the drying chamber 51. Outdoor air is suctioned by a fan 59 as indicated by arrows in FIGS. 6 and 7. The suctioned air is temporarily introduced via air filters (not shown) into the second chamber 52 and then fed via an opening (not shown) formed through a ceiling 51*a* of the drying chamber 51 into the drying chamber 51.

On the other hand, the air exhaust means 57 exhausts air humidified in the drying chamber 51 outdoors via a pipe 63 and is equipped with a blower.

The respective pipes 58 and 63 of the air charge means 56 and the air exhaust means 57 are respectively provided with valves, which are manually or automatically operated to thereby regulate the openness of each of the pipes.

The air charge means 56 regulates the quantity of suctioned air by means of a regulator 87 of a control panel 70. The quantity of suctioned air is set by means of an air quantity setting device 88.

On the other hand, the air exhaust means 57 regulates the quantity of exhausted air by means of a regulator 89. The quantity of exhausted air is set by means of an air quantity setting device 90. For example, the air exhaust capacity ranges from a maximum of 1500 $m^3/h$ to a minimum of 500 $m^3/h$.

Both of these air charge means 56 and air exhaust means 57 are operated by a 100-V power source 62.

Figure 8:
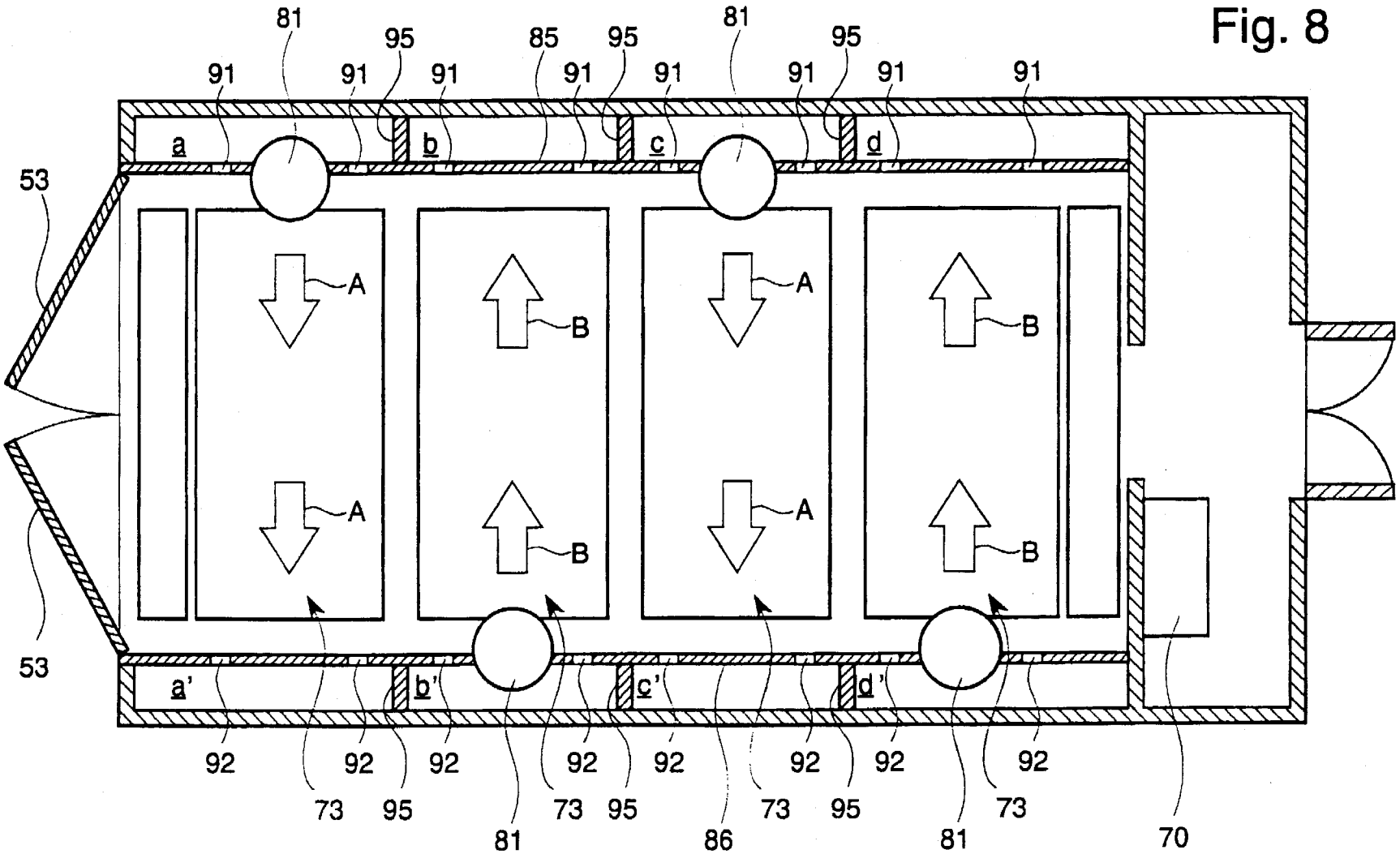
FIG. 8 is a schematic plan showing the inside of a drying chamber provided according to the above embodiment.

Four far infrared radiation heaters 73 shown in FIGS. 7 and 8 are substantially linearly disposed on the ceiling 51*a* of the drying chamber 51.

The structure of each of the far infrared radiation heaters 73 is the same as that of the far infrared radiation heater 38 shown in FIG. 3.

The use of the above far infrared radiation heaters 73 leads to free regulation of the drying temperature and to releasing of moisture not only from the surface of each of the objects to be dried but also from the center thereof with less energy input because of high far infrared radiation efficiency. Therefore, the objects to be dried can effectively be dried up to the inner parts thereof at a lowered cost.

In this embodiment, as shown in FIGS. 6 to 8, bulkhead platings 85, 86 are vertically disposed opposite to a pair of mutually opposite long side walls, respectively, to thereby define a partitioned narrow interstice in the vicinity of each of the long side walls. These interstices are partitioned by a plurality of diaphragms 95 into a set of spaces a, b, c and d, and a set of spaces a', b', c' and d', respectively. That is, each of the above interstices is partitioned into four small spaces each having a width nearly equal to the width of one of the far infrared radiation heaters 73. A vast plurality of openings 91, 92 are formed in the bulkhead platings 85, 86 along the direction of height as from positions slightly higher than the floor level. By virtue of the formation of such a vast plurality of openings 91, 92, for example, the air of the space a can be blown through the openings 91 in the substantially horizontal direction, and, contrarily, the space a' opposite thereto can suction the air blown from the openings 91 through the openings 92. Further, as shown in FIGS. 6 to 8, sirocco fans 81 as circulatory blowing means capable of forcibly introducing air and circulating the air are disposed in alternate positions beside the linearly arranged far infrared radiation heaters 73. One sirocco fan 81 is provided for one far infrared radiation heater 73. The sirocco fans 81 are positioned at upper parts of the spaces a and c and upper parts of the spaces b' and d' as shown in FIG. 8. That is, as shown in the plan of FIG. 8, the sirocco fans 81 are disposed alternately right and left in a fashion such that a first one is put left as viewed from the gate 53, a second one right as viewed from the gate 53, a third one left as viewed from the gate 53 and so on. The above positioned sirocco fans 81 have respective blown air ports which are directed downward so as to blow air into the spaces a and c and the spaces b' and d'.

The construction of the system 50 for drying objects to be dried according to this embodiment is as described above. The function of the system will now be described below.

At this time, a vast plurality of objects to be dried 55 are housed in layered form in each of a plurality of, for example, four trucks 54 and accommodated in the drying chamber 51. The air charge means 56, air exhaust means 57 and far infrared radiation heaters 73 are regulated by the control panel 70 and are individually driven. Thus, the entirety of the system is air-conditioned.

In this drying system 50, outside fresh air is fed via the second chamber 52 into the drying chamber 51 by the air charge means 56. In the drying chamber 51, an air stream is circulated in the entirety thereof. The air is exhausted from the drying chamber 51 to the outside by the air exhaust means 57. In the drying chamber 51, air exhaust is conducted with greater power than that of air charge, so that the pressure is held at, for example, 3 mb or more, preferably 10 mb or more below atmospheric pressure.

Further, in the drying chamber 51, far infrared radiation which is easily absorbed by the objects to be dried 55 is emitted from the ceiling 51*a* by the drive of the four far infrared radiation heaters 73. On the other hand, the air of the second chamber 52 is fed into the predetermined spaces a, c, b' and d' by the sirocco fans 81. Thus, the air is introduced into the left space below the first far infrared radiation heater 73 positioned near the gate 53 and the introduced air is blown through the openings 91 in the substantially horizontal direction as indicated by the arrow A in FIG. 8. As a result, moisture evaporation is promoted from the objects to be dried 55 positioned in that vicinity especially by the effect of the air stream flowing in the direction of the arrow A.

On the other hand, below the far infrared radiation heater 73 positioned second as viewed from the gate 53, the air is introduced into the right space b' because the sirocco fan 81 is positioned on the right side and the introduced air is blown through the openings 92 in the substantially horizontal direction as indicated by the arrow B in FIG. 8.

Likewise, the introduced air is blown in the direction of the arrow A below the third far infrared radiation heater and in the direction of the arrow B below the fourth far infrared radiation heater. That is, in the drying chamber 51, the air is circulated in the entirety thereof and opposite horizontal air streams alternate below the far infrared radiation heaters 73.

As apparent from the above, in this embodiment, the inside of the drying chamber 51 is substantially uniformly heated by far infrared radiation, the inside of the chamber is continuously held in a state of reduced pressure by means of the air exhaust means 57, and a horizontal air stream flows in the vicinity of housed objects to be dried 15 to thereby circulate the air inside the chamber. Therefore, no matter where the objects to be dried are positioned, they can be dried rapidly and uniformly.

Upon completion of the predetermined drying in the above manner, it is preferred that the driving of the far infrared radiation heaters 73 be terminated and, thereafter, one or more sirocco fans 81 be continuously driven to thereby cure the objects to be dried only by natural ventilation for a given period of time.

In this embodiment, the dried products can be produced always throughout the year without the need of caring about the effects of rain or other outside weather conditions. Further, the number of days in which the production is to be effected can be reduced, so that the monthly treatment capacity can be markedly increased. For example, the drying of salmon in a drying chamber of 7 m in length can output dried salmon in an amount as large as 5 t per month.

The objects to be dried in the drying chamber 51 are the same as those mentioned in the previous embodiment.

The functions and effects of this drying system 50 are the same as described in the previous embodiment, so that detailed description is omitted.

The second embodiment of the present invention is as described above, which by no way limits the present invention.

For example, opposite horizontal air stream flows alternate inside the drying chamber 51 in the above embodiment. Instead, for example, all sirocco fans 81 may be positioned on the same side to thereby cause all air streams to flow in the same horizontal direction.

Further, the air streams flowing in alternately opposite directions can be so set as to flow counter at redetermined time intervals. This setting of the air streams so as to flow counter at predetermined time intervals can render the air circulation more uniform and can accomplish drying of a vast plurality of objects to be dried with improved uniformity.

Still further, for example, pipes may replace the bulkhead platings 85, 86 to thereby use the pipelines thereof for creating horizontal air streams.

A further system for drying objects to be dried according to a third embodiment of the present invention will be described below with reference to FIGS. 9 to 11.

Figure 9:
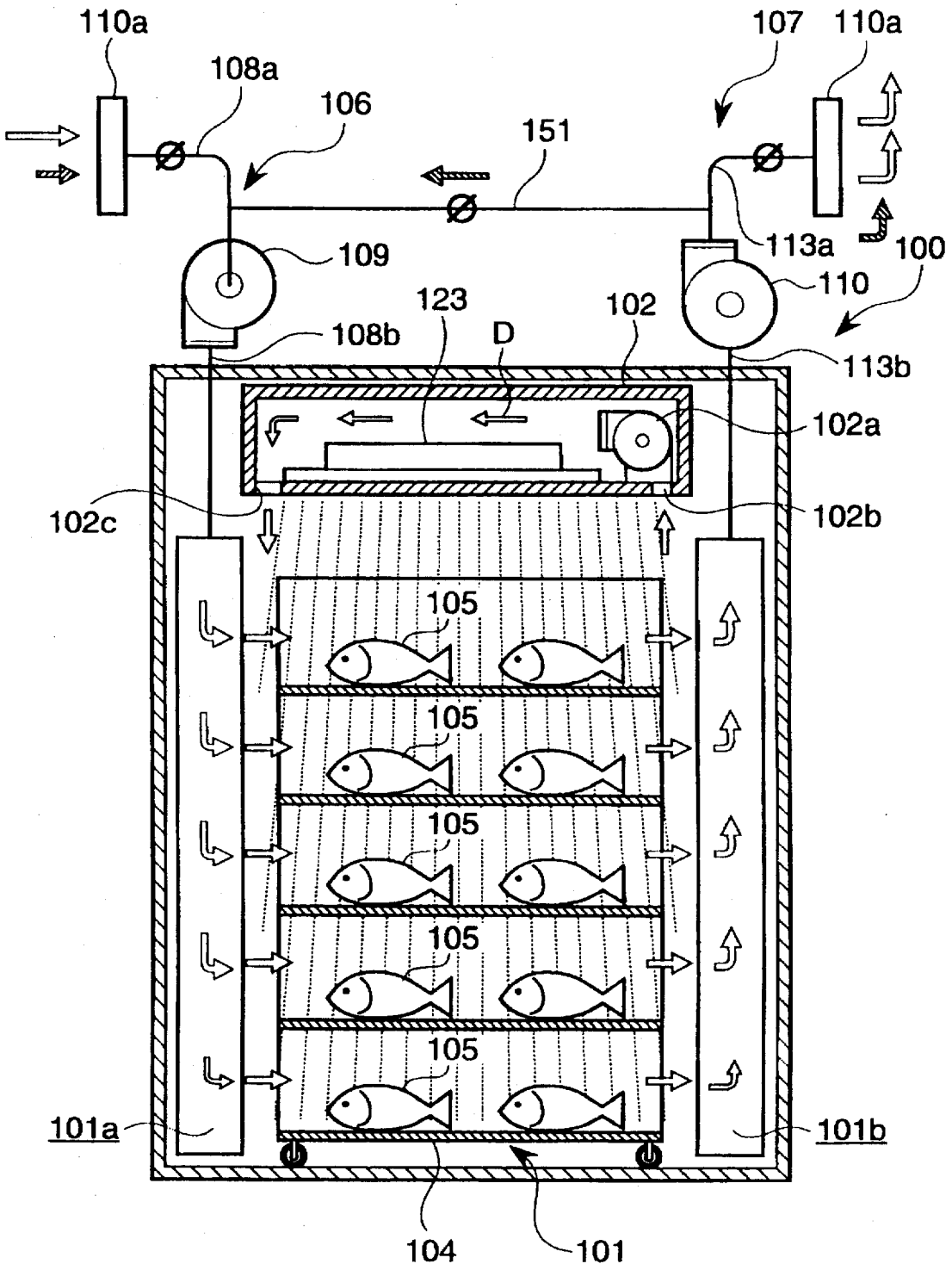
FIG. 9 is a sectional view showing a system for drying objects to be dried according a third embodiment of the present invention.
Figure 10:
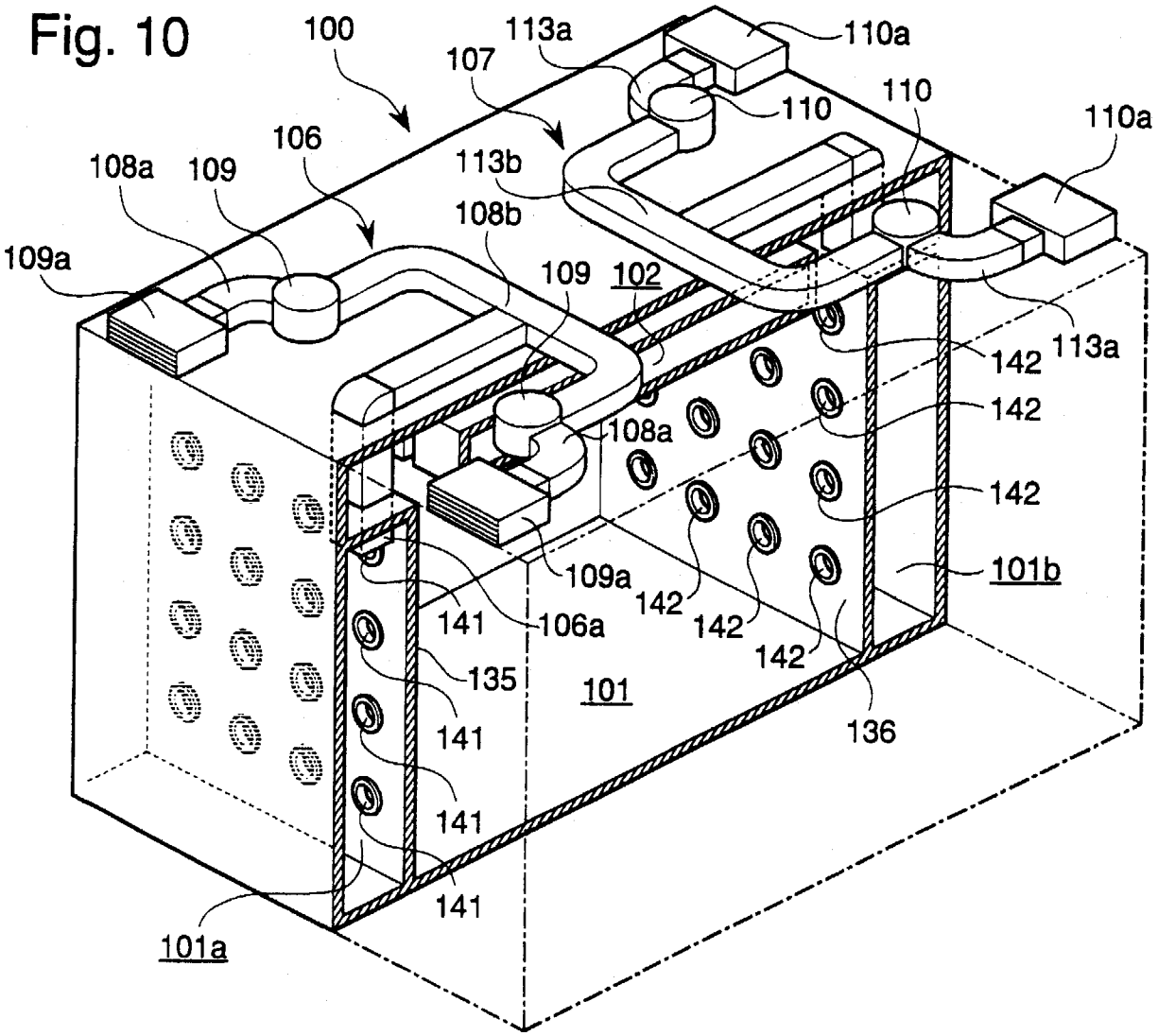
FIG. 10 is a schematic perspective view showing the drying system according to the above embodiment.
Figure 11:
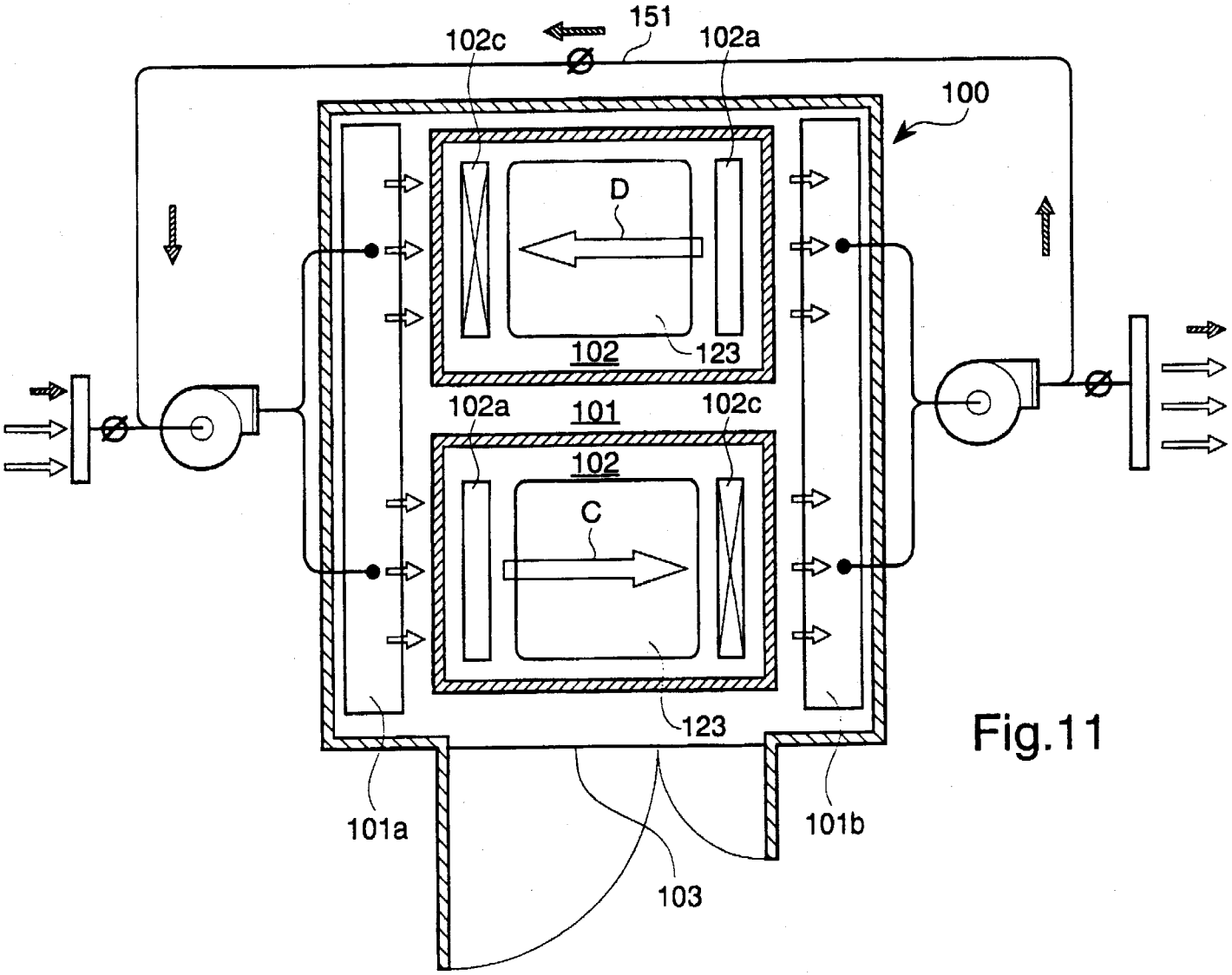
FIG. 11 is a schematic plane view showing the drying system according to the above embodiment.
Figure 12:
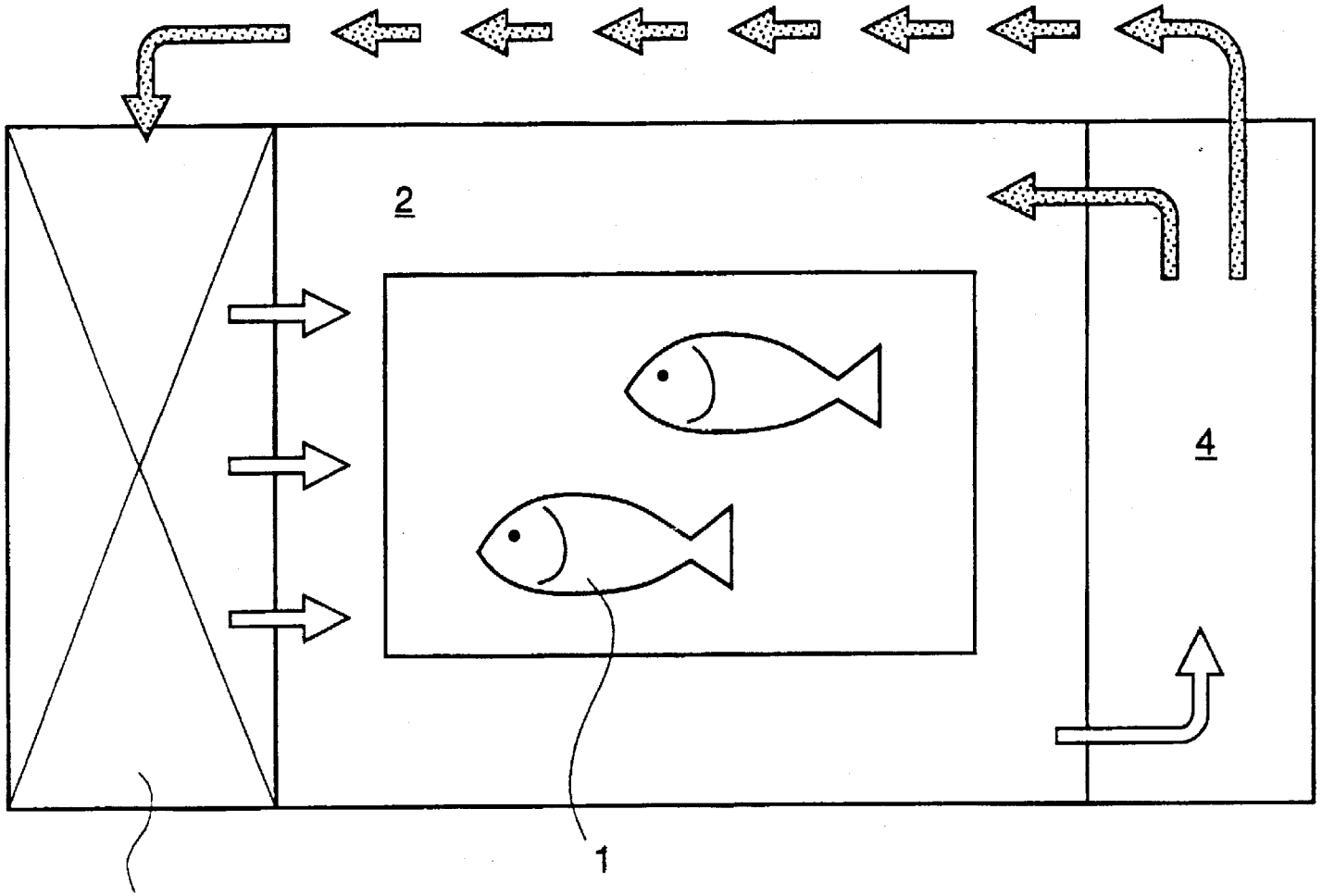
Fig. 12 PRIOR ART
FIG. 12 is a plan showing the conventional drying system of the prior art.

FIG. 9 schematically shows a system for drying objects to be dried according to a third embodiment of the present invention, and FIG. 10 is a schematic perspective view thereof and FIG. 11 is a schematic plan view thereof.

This drying system 100 is constructed in a large box frame with thermal insulating structure and can be installed outdoors. In the drying system 100, two of second chambers 102 are constructed above a drying chamber 101 having its periphery surrounded with a thermal insulating material. The drying chamber 101 has a gate 103 through which entrance and exit can be made.

Truck 104 which is loaded with a vast plurality of objects to be dried 105 in multilayered form are placed in the drying chamber 101 to thereby have the objects to be dried 105 housed in the drying chamber 101.

The two second chambers 102 are arranged in a direction from the gate to the inside of the drying chamber, in each of which an infrared radiation heater 123 is provided. The structure of each of the far infrared radiation heaters 123 is the same as that of the far infrared radiation heater 38 shown in FIG. 3.

The use of the above far infrared radiation heaters 103 leads to free regulation of the drying temperature and to releasing of moisture not only from the surface of each of the objects to be dried but also from the center thereof with less energy input because of high far infrared radiation efficiency. Therefore, the objects to be dried can effectively be dried up to the inner parts thereof at a lowered cost.

Each of the second chambers 102 is provided with an fan 102*a* for circulating an air in the drying chamber 101. The fan 102*a* introduces air into the second chamber 102 from an opening 102*b* formed under the fan 102*a*. The air introduced into the two second chambers 102 flows in a direction indicated by arrows C and D in FIGS. 9 and 11, and is returned to the drying chamber 101 from an opening 102*c* formed on a bottom wall of each of the second chambers 102, where the bottom wall composes a part of a ceiling of the drying chamber.

Accordingly, the fan 102*a* generates a circulation of the air opposite to the arrow C or D under each of the second cambers 102. Further, as shown in FIG. 11, the arrows C and D are opposite to each other.

The drying chamber 101 is provided with air charge means 106 and air exhaust means 107. An air charge port 106*a* of the air charge means 106 is connected with a first side chamber 101*a* disposed at a side portion of the drying chamber 101 and an exhaust port 107*a* of the exhaust means 107 is connected with a second side chamber 102*b* disposed at the other side of the drying chamber 101.

The air charge means 106 comprises an air filter 109*a*, a pipe 108*a*, a blower 109 and a pipe 108*b* which are connected in this order. The air charge means 106 introduces outdoor fresh air via a pipes 108*a* and 108*b* into the drying chamber 101 by the blower 109 and circulates an air stream in the drying chamber 101. Namely, outdoor air is suctioned from the air filter 109*a* by the blower 109 disposed between the pipes 108*a* and 108*b*, as indicated by arrows in FIGS. 9–11. The suctioned air is temporarily introduced into the first side chamber 101*a* and then, as described below, fed via openings 141 formed through a bulkhead plating 135 of the first side chamber 101*a* into the drying chamber 101.

On the other hand, the air exhaust means 107 comprises an air filter 110*a*, a pipe 113*a*, a blower 110 and a pipe 113*b* which are connected in this order. The air exhaust means 107 exhausts air humidified in the drying chamber 101 outdoors via openings 142 formed through a bulk head plate 136 of the second side chamber 101*b* and pipes 108*a* and 108*b*.

In this embodiment, as shown in FIGS. 9–11, bulkhead platings 135, 136 are vertically disposed opposite to a pair of mutually opposite side walls, respectively, to thereby define the narrow first and second side chambers 101*a* and 101*b* in the vicinity of each of the side walls. A vast plurality of openings 141, 142 are formed in the bulkhead platings 135, 136 along the direction of height as from positions slightly higher than the floor level. By virtue of the formation of such a vast plurality of openings 141, 142, for example, the air suctioned outdoors into the first side chamber 101*a* can be blown through the openings 141 in the substantially horizontal direction, and, contrarily, the second side chamber 101*b* opposite thereto can suction the air blown from the openings 141 through the openings 142. Further, the air suctioned from the drying chamber 101 into the second side chamber 101*b* is exhausted outdoors.

The respective pipes 108*a*, 108*b*, 113*a* and 113*b* of the air charge means 106 and the air exhaust means 107 are respectively provided with valves, which are manually or automatically operated to thereby regulate the openness of each of the pipes.

The air charge means 106 and the air exhaust means 107 are each provided with a regulating system for regulating a quantity of the air flowing therethrough. The suctioning power of the air charge means 106 or the exhausting power of the air exhaust means 107 is suitably regulated by the regulating system for maintaining the inside of the drying chamber at a reduced pressure. In this connection, the pipe 108*a* of the charging means 106 and the pipe 113*a* of the exhaust means 107 in this embodiment are connected with a connecting pipe 151 provided with a valve, as an assistant means for adjusting the air pressure in the drying chamber 101. Decrease in the quantity of air suctioned by the blower 109 can be coped with the regulation of the valve openness, as indicated by hatched arrows in FIGS. 9 and 11. Further, by such regulation, the heated air to be exhaust can be circulated.

The construction of the system 100 for drying objects to be dried according to this embodiment is as described above. The function of the system will now be described below.

At this time, a vast plurality of objects to be dried 105 are housed in layered form in the truck 104 and accommodated in the drying chamber 101. The air charge means 106, air exhaust means 107 and far infrared radiation heaters 123 are regulated by a control panel (not shown) as described in the second embodiment and are individually driven. Thus, the entirety of the system is air-conditioned.

In this drying system 100, outside fresh air is fed via the first side chamber 101*a* into the drying chamber 101 by the air charge means 106 and, at this time, is blown through the openings 141 formed on the bulkhead plating 135 in the substantially horizontal direction. In the drying chamber 101, the blown air flows in the substantially horizontal direction, as indicated by arrows A shown in FIGS. 9 and 11. As a result, moisture evaporation is promoted from the objects to be dried 105 positioned in that vicinity.

The humidified air in the drying chamber 101 is suctioned via the vast plurality of the openings 142 formed on the bulkhead plating 136, introduced into the second side chamber 101*b* and then exhausted to the outside by the exhaust means 107. In the drying chamber 101, the pressure is held at, for example, 3 mb or more, preferably 10 mb or more below atmospheric pressure.

Further, in the drying chamber 101, far infrared radiation which is easily absorbed by the objects to be dried 10is emitted from the ceiling by the drive of the far infrared radiation heaters 123.

As apparent from the above, in this embodiment, the inside of the drying chamber 101 is substantially uniformly heated by far infrared radiation, the inside of the chamber is continuously held in a state of reduced pressure by means of the air exhaust means 107, and a horizontal air stream flows in the vicinity of housed objects to be dried 105. Therefore, no matter where the objects to be dried are positioned, they can be dried rapidly and uniformly.

Moreover, in this embodiment, the fans 102*a* disposed in the second chambers 102 generate a circulation of the air opposite to the arrow C or D under the second chambers 102, respectively. Further, as shown in FIG. 11, the arrows C and D are opposite to each other. As a result, the air in the chamber is evenly circulated.

In this embodiment, the great amount of the dried products can be produced always throughout the year, as same as in the case of the first or second embodiment of the present invention. The objects 105 to be dried are the same as those mentioned in the previous embodiments and the same functions and effects as in the first and second embodiments can be expected.

The third embodiment of the present invention is as described above, which by no way limits the present invention, and can be variously modified within the scope of the present invention.

EFFECT OF THE INVENTION

As described above, in the system for drying objects to be dried according to the present invention, outside air is introduced into the drying chamber by means of the air charge means. While the air stream is circulated inside the drying chamber by this air charge means, humidified air is exhausted by means of the air exhaust means. This air exhaust means exhausts air in quantity much greater than introduced by the air charge means to thereby maintain the inside of the drying chamber in a state of reduced pressure. The far infrared radiation heater uniformly heats the inside of the drying chamber. Therefore, the objects to be dried can be dried up to the inner parts thereof with less energy input within a short period of time. Moreover, inside the drying chamber, horizontal air stream is positively created by means of the circulatory blowing means, so that the drying of the objects to be dried can be promoted and simultaneously uniformized. Consequently, the drying can be effected at the optimum temperature within a short period of time, so that there is no waste of time and energy, and that there is no danger of temperature rise beyond necessity.

In addition, cooling of humidified air is not needed, so that, in this respect as well, energy saving can be attained. Further, highly fresh dried products whose oxidation degree is low if any can be obtained.

Also, dried products can be obtained without the influence of weather, so that planned production thereof can be effected.

What is claimed is:

1. A system for drying objects to be dried comprising a drying chamber having walls including side walls and a ceiling in which objects to be dried are housed, a far infrared radiation heater disposed on at least a part of the walls to evenly heat the inside of the drying chamber with heat emitted from the far infrared radiation heater and air charge and air exhaust means both communicating with the inside of the drying chamber, the former introducing outside air into the drying chamber while the latter exhausting the air from the drying chamber in quantity much greater than that of the air introduced by the air charge means to thereby continuously maintain the inside of the drying chamber in a state of reduced pressure, wherein the temperature of the inside of the drying chamber is detected with the use of a temperature sensor and the output of the far infrared radiation heater regulated on the basis of the temperature detected by the temperature sensor and wherein the air charge and air exhaust means being separately controlled.

2. The system for drying objects to be dried as claimed in claim 1, wherein circulatory blowing means is provided at one of a pair of mutually opposite side wall surfaces inside the drying chamber, the circulatory blowing means being capable of generating a substantially horizontal air stream flowing to the opposite side wall surface, to thereby cause the circulatory blowing means to feed air so as to form a horizontal air stream flowing toward the object to be dried.

3. A system for drying objects to be dried comprising a drying chamber in which a plurality of trucks each having a vast plurality of objects to be dried shelfwise housed therein and can be linearly accommodated, a plurality of far infrared radiation heaters disposed at predetermined intervals at upper parts of the drying chamber to evenly heat the inside of the drying chamber with the heat emitted from the far infrared radiation heaters and air charge and air exhaust means both communicating with the inside of the drying chamber, the former introducing outside air into the drying chamber while the latter exhausting the air from the drying chamber in quantity much greater than that of the air introduced by the air charge means to thereby continuously maintain the inside of the drying chamber in a state of reduced pressure, and wherein circulatory blowing means is provided at one of a pair of mutually opposite side wall surfaces inside the drying chamber, the circulatory blowing means being capable of generating a substantially horizontal air stream flowing the one side wall surface to the opposite side wall surface, to thereby cause the circulatory blowing means to feed air so as to form a horizontal air stream flowing toward the inner part of the trucks.

4. The system for drying objects to be dried as claimed in claim 3, wherein, with respect to the plurality of far infrared radiation heaters disposed at predetermined intervals, the air stream generated by the circulatory blowing means is so set as to flow from the one side wall surface to the opposite side wall surface along the side of a first far infrared radiation heater, to flow from the opposite side wall surface to the one side wall surface along the side of a second far infrared radiation heater, to flow from the one side wall surface to the opposite side wall surface along the side of a third far infrared radiation heater, and thus to alternately flow in the same direction in the entirety of the drying chamber.

5. The system for drying objects to be dried as claimed in claim 4, wherein the air stream generated by the circulatory blowing means is so set as to flow counter at predetermined time intervals.

* * * * *

UNITED STATES PATENT AND TRADEMARK OFFICE

CERTIFICATE OF CORRECTION

PATENT NO. : 5,680,712

DATED : October 28, 1997

INVENTOR(S) : Shin Kiyokawa, Masaru Yanagisawa, Hideo Namiki

It is certified that error appears in the above-identified patent and that said Letters Patent is hereby corrected as shown below:

Title Page, under [56] References Cited, U.S. PATENT DOCUMENTS, refer to "4,619,054", "Sata" should read --Sato--.

Title Page, under [56] References Cited, OTHER PUBLICATIONS, second item, "Paten Abstracts" should read --Patent Abstracts--.

Column 5 Line 29 "objects to be dried is" should read --objects to be dried 15--.

Column 13 Line 7 "to be dried 10is" should read --to be dried 105 is--.

Signed and Sealed this

Twenty-fourth Day of February, 1998

*Attest:*

Bruce Lehman

BRUCE LEHMAN

*Attesting Officer*

*Commissioner of Patents and Trademarks*